US005385131A

United States Patent [19]

Macon

[11] Patent Number: 5,385,131

[45] Date of Patent: Jan. 31, 1995

[54] EMISSION CONTROL ASSEMBLY

[76] Inventor: Carolyn B. Macon, 29 Sunnyfield Ter., Neptune, N.J. 07754

[21] Appl. No.: 179,358

[22] Filed: Jan. 10, 1994

Related U.S. Application Data

[63] Continuation-in-part of Ser. No. 019,176, Feb. 16, 1993, abandoned.

[51] Int. Cl.[6] ..... F02M 27/00

[52] U.S. Cl. ..... 123/538

[58] Field of Search ..... 123/536, 537, 538, 539, 123/522, 3, 1 A; 208/134, 295

[56] References Cited

U.S. PATENT DOCUMENTS

| | | | |
|---|---|---|---|
| 4,429,665 | 2/1984 | Brown | 123/538 |
| 4,930,483 | 6/1990 | Jones | 123/538 |
| 5,044,347 | 9/1991 | Ullrich | 123/536 |
| 5,049,499 | 9/1991 | Daywalt | 123/538 |
| 5,154,153 | 10/1992 | Macgregor | 123/536 |
| 5,197,446 | 3/1993 | Daywalt et al. | 123/538 |

*Primary Examiner*—Tony M. Argenbright
*Assistant Examiner*—M. Macy
*Attorney, Agent, or Firm*—Louis E. Marn

[57] ABSTRACT

An emission control assembly comprised of a tubular member defining a chamber in which is positioned an elongated element having elliptically-shaped depressions wherein the assembly is disposed in a fuel line upstream of the internal combustion engine.

2 Claims, 1 Drawing Sheet

EMISSION CONTROL ASSEMBLY

CROSS-REFERENCE TO RELATED APPLICATION

This application is a continuation-in-part of U.S. application Ser. No. 08/019,176, filed Feb. 16, 1993, now abandoned.

BACKGROUND OF THE INVENTION

1. Field of Invention

This invention relates to internal combustion engines, and more particularly to an assembly for improving the ability of an internal combustion engine to utilize fossil fuel combustions under conditions to improve ignition control and reduce levels of engine exhaust emissions.

2. Brief Description of the Prior Art

Many retrofitted devices have been developed to be inserted in an internal combustion engine assembly to alter the mixtures, vapors, injectors, ignitions, temperatures, lubricants, exhaust and the like of the original equipment manufacturer. Such retrofitted devices have been created in an attempt to effect improvement in an internal combustion engine's ability to perform, economize and utilize fossil fuel combustions. Examples of such assemblies are illustrated in, for example, U.S. Pat. Nos. 4,798,191; 5,069,190; 5,069,191; 5,074,273; 5,154,153 and 5,197,446. While such devices may alter, deter, eliminate or enhance existing components when applied to combustion engines, the effectiveness of such devices to reduce emission levels with concomitant improvement in combustion efficiency is not established.

OBJECTS OF THE INVENTION

It is an object of the present invention to provide an improved emission control assembly for improving combustion efficiency with concomitant reduction in engine exhaust emissions.

Another object of the present invention is to provide an improved emission control assembly which may be retrofitted in light duty internal combustion engines to improve combustion efficiency with concomitant reduction in engine exhaust emissions.

A still further object of the present invention is to provide an assembly which may be facilely retrofitted into an internal combustion engine to improve combustion efficiency with concomitant reduction in engine exhaust emissions.

SUMMARY OF THE INVENTION

These and other objects of the present invention are achieved by an emission control assembly comprised of a tubular member defining a chamber in which is positioned an elongated element having elliptically-shaped depressions disposed in a fuel line upstream of the internal combustion engine.

BRIEF DESCRIPTION OF THE DRAWINGS

These and other objects and advantages of the present invention will be more clearly understood from the following detailed description when taken with the accompanying drawings, in which.

DETAILED DESCRIPTION OF THE PRESENT INVENTION

Figure 1:
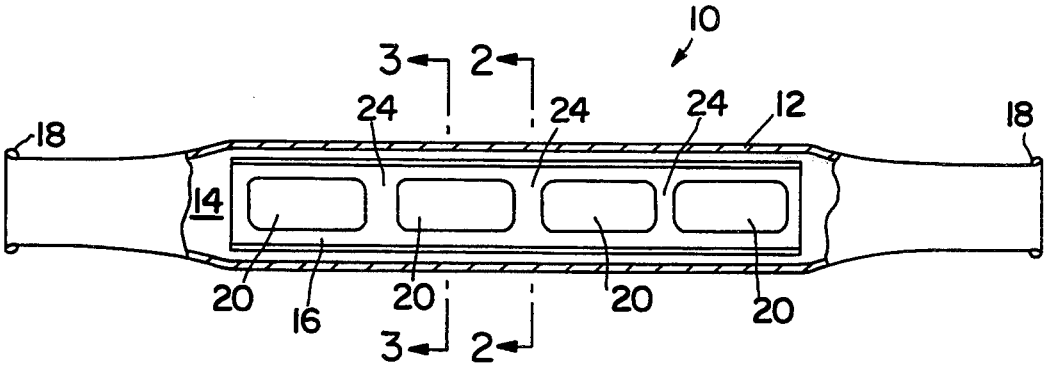
FIG. 1 is an elevational view, partially in section of the emission control assembly of the present invention.

Referring now to the drawings, there is illustrated an emission control assembly of the present invention, generally indicated as 10, comprised of a tubular housing member 12 defining a chamber 14 for an elongated member 16. The tubular housing member 12 is copper and is preferably formed with end flange members 18 by swagging techniques after positioning of the elongated member 16 within the chamber 14 of the tubular housing member 12 to position in loosely fitting or floating relationship the elongated member 16 within the housing 12.

Figure 2:
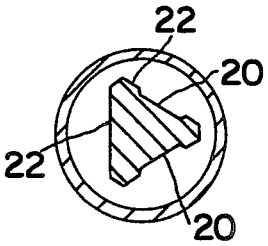
FIG. 2 is a cross section of the emission control assembly taken along the lines of 2—2 of FIG. 1.
Figure 3:
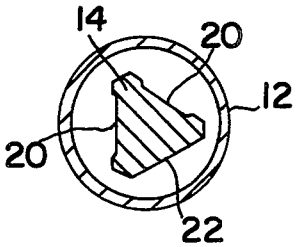
FIG. 3 is a cross sectional view of the emission control assembly taken along the lines of 3—3 of FIG. 1.

The elongated member 16 is formed of cast aluminum, preferably an aluminum alloy containing less than about 5 weight carbon and 0.75 weight % bronze. The elongated member 16 is generally triangularly-shaped in cross section referring to FIGS. 2 and 3 formed with elongated elliptically-shaped depressions 20 along the sides 22. The depressions 20 are formed in staggered array configuration lengthwise along each side 22 of the elongated member 16, i.e., areas 24 between adjacent elliptically-shaped depressions not corresponding positioned to like areas 24 on the other sides 22 of the triangularly-shaped elongated member 16.

In operation, while Applicant does not wish to be held to any theory of the invention, the passage of fuel through the chamber 14 of the housing member 12 and about the elongated member 16 effects molecular orientation to permit more total combustion with the combustion supporting medium (i.e., air) to reduce emission and more particularly to reduce HC's as evidenced by the following Table I with concomitant improvement in fuel mileage.

TABLE I

| Yr | Make | Model | Engine | Fuel System | Mileage | Before HC-PPM | After HC-PPM |
|---|---|---|---|---|---|---|---|
| 86 | Chev | Celeb | 6 cyl | Carb | 84,123 | 253 | 15 |
| 92 | Buick | Cent | 6 cyl | Inj | 15,136 | 48 | 11 |
| 87 | Niss | KCab | 4 cyl | Carb | 68,000 | 78 | 47 |
| 90 | Buick | Cent | 6 cyl | TBody | 27,000 | 8 | 3 |
| 87 | Suba | | 4 cyl | Carb | 54,756 | 12 | 7 |
| 82 | Niss | 280Z | 4 cyl | Carb | 108,377 | 85 | 34 |
| 89 | Jeep | Cher | 8 cyl | Inj | 48,823 | 78 | 62 |
| 85 | Buick | Sky | 6 cyl | Carb | 85,000 | 15 | 2 |

While the present invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. An emission control assembly, which comprises:

a tubular housing member formed of copper and defining a chamber and having end flange portions; and a triangularly-shaped elongated member disposed in said chamber of said tubular housing member, said triangularly-shaped elongated member being formed with elliptically-shaped depressions elongated in an axial direction of said elongated member, said elongated member being formed of an aluminum alloy comprised of aluminum, carbon and bronze, carbon being present in an amount of less than about 5 weight percent and bronze being present in an amount of less than 0.75 weight percent, said triangularly-shaped elongated member being disposed in loosely fitting relationship within said chamber of said tubular housing member, said end flange portions of said tubular housing member being formed by swagging technique after positioning said triangularly-shaped elongated member within said chamber of said tubular housing member.

2. The emission control assembly as defined in claim 1 wherein said elliptically-shaped depressions in one side of said elongated member are in staggered array with respect to depressions in other sides of said elongated member.

* * * * *